United States Patent [19]

Podolan et al.

[11] 4,004,371

[45] Jan. 25, 1977

[54] WINDOW REGULATOR MECHANISM

[75] Inventors: Edward G. Podolan, Utica; Lawrence A. Surhigh, Warren, both of Mich.

[73] Assignee: General Motors Corporation, Detroit, Mich.

[22] Filed: May 9, 1975

[21] Appl. No.: 575,953

[52] U.S. Cl. ..... 49/352

[51] Int. Cl.[2] ..... E05F 11/48

[58] Field of Search ..... 49/349, 325, 352

[56] References Cited

UNITED STATES PATENTS

| | | | |
|---|---|---|---|
| 1,627,697 | 5/1927 | Fredericks | 49/352 |
| 1,997,646 | 4/1935 | Miller | 49/352 X |
| 3,035,829 | 5/1962 | Stotz | 49/325 X |
| 3,702,041 | 11/1972 | Podolan | 49/325 X |

FOREIGN PATENTS OR APPLICATIONS

| | | | |
|---|---|---|---|
| 1,708,173 | 3/1968 | Germany | 49/352 |
| 274,645 | 7/1927 | United Kingdom | 49/352 |

*Primary Examiner*—Kenneth Downey
*Attorney, Agent, or Firm*—John P. Moran

[57] ABSTRACT

An automotive window regulator mechanism including a track having two substantially vertical track-sections and an interconnecting laterally extending section, a perforated plastic tape slidably mounted in the track, an actuator including a clutch and a sprocket for driving the perforated tape along the track, and a bracket arrangement secured to a window pane at the midpoint of the bottom edge thereof and connecting same to an end of the perforated tape for travel therewith up or down adjacent one of the two vertical track-sections.

5 Claims, 9 Drawing Figures

WINDOW REGULATOR MECHANISM

This invention relates generally to automotive window regulators and, more specifically, to a perforated tape and actuator arrangement for opening and closing a side window.

Window regulator mechanisms have heretofore generally involved relatively large gear sectors and rather extensive pivotable linkage means for raising and lowering automotive windows. While such mechanisms are generally satisfactory, there is a need for a simplified, economical, and efficient window regulator mechanism which does not require such gear sectors and linkage means.

Accordingly, an object of the invention is to provide such an improved, simplified, economical, and efficient window regulator means.

Another object of the invention is to provide an automotive window regulator mechanism including a track having two substantially vertical track-sections and an interconnecting laterally extending section mounted on the inner door panel, a perforated plastic tape slidably mounted in the track, an actuator assembly including a clutch and associated sprocket for driving the perforated tape along the track, and a connector device secured to a window pane at the midpoint of the bottom edge thereof and connecting same to an end of the perforated tape for travel therewith up or down adjacent one of the two vertical track sections.

A further object of the invention is to provide a window regulator mechanism including an actuator assembly mounted within the side walls of a vehicular door in the forward half thereof, a bracket assembly secured to the bottom edge of a window pane at substantially the center point therealong, and a continuous trisectioned track in which a perforated tape is slidably mounted, adapted to being actuated by a sprocket of the actuator assembly. One section of the track extends substantially vertically upwardly to the actuator assembly to operatively connect the tape to such assembly; a second section extends generally laterally from the actuator assembly to a position adjacent the bracket assembly when the latter is in its uppermost position; and the third section extends downwardly from such uppermost bracket assembly position to a location near the bottom edge of the door, such third section being arcuate-shaped to conform to the shape of the window pane. The bracket assembly operatively connects the window pane to the perforated tape such that any movements of the tape caused by operation of the actuator assembly actuates the window pane up or down in a path parallel to the arcuate-shaped track section.

These and other objects and advantages of the invention will be apparent when reference is made to the following description and accompanying drawings, wherein.

Figure 1:
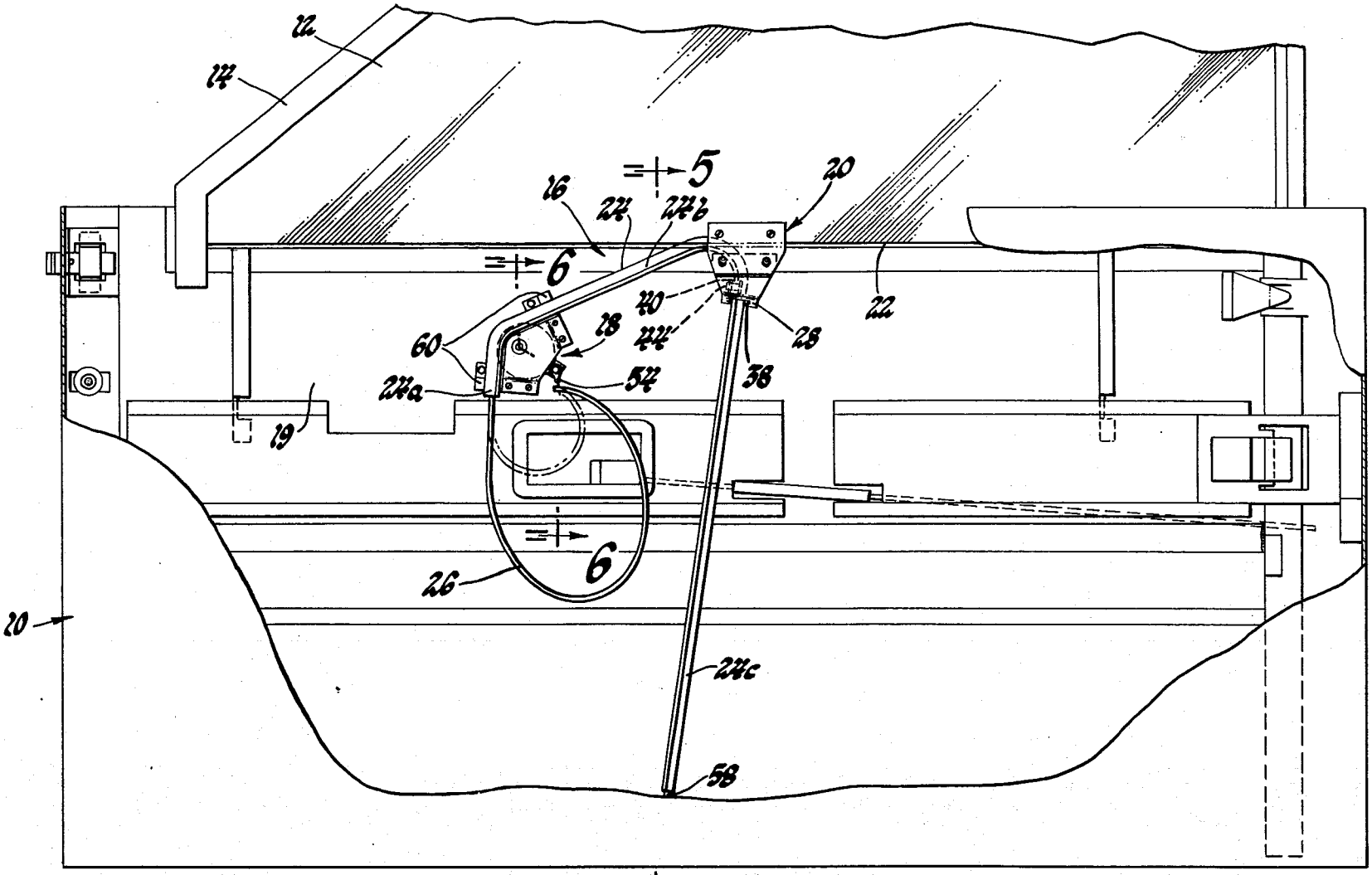
FIG. 1 is a fragmentary cross-sectional view of an automotive door embodying the invention.
Figure 2:
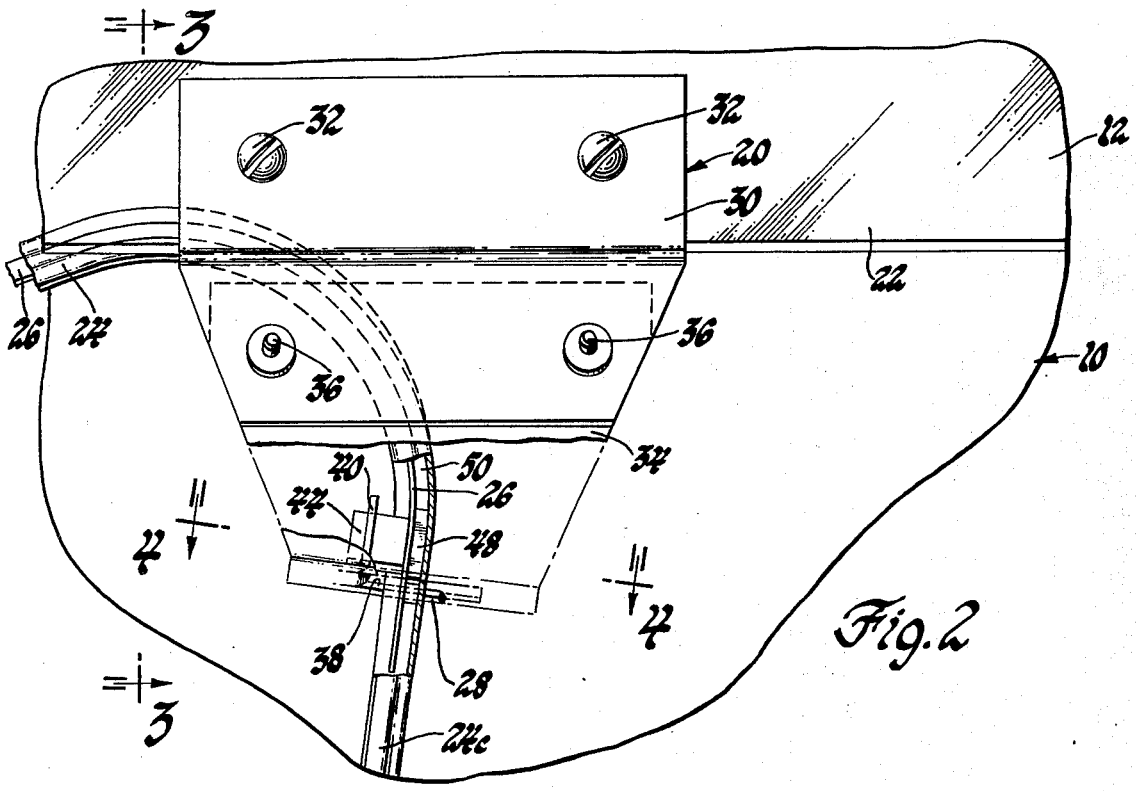
FIGS. 2 and 7 are enlarged fragmentary cross-sectional views of portions of the FIG. 1 structure.
Figure 3:
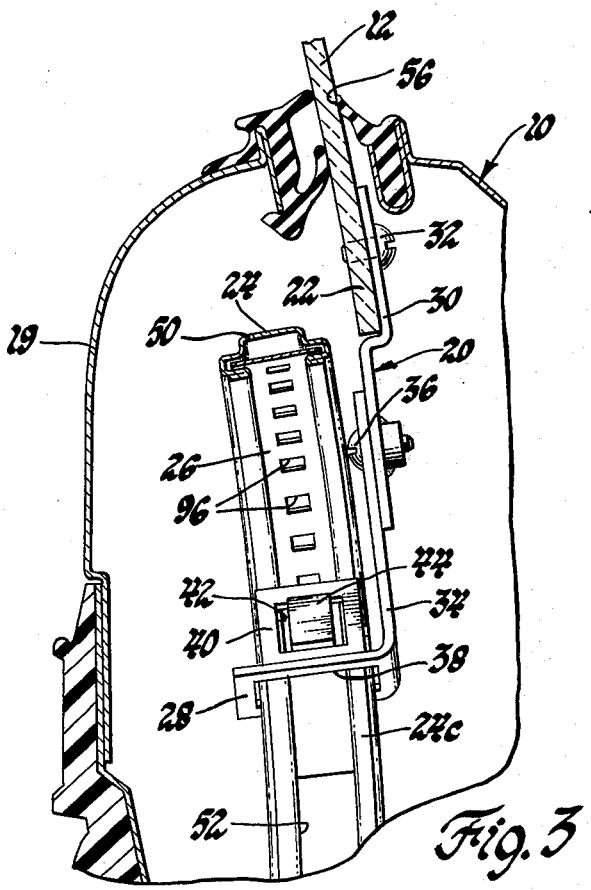
Figure 4:
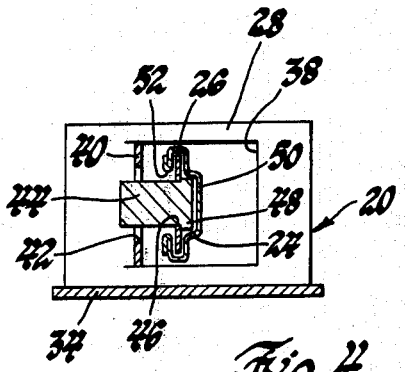
Figure 5:
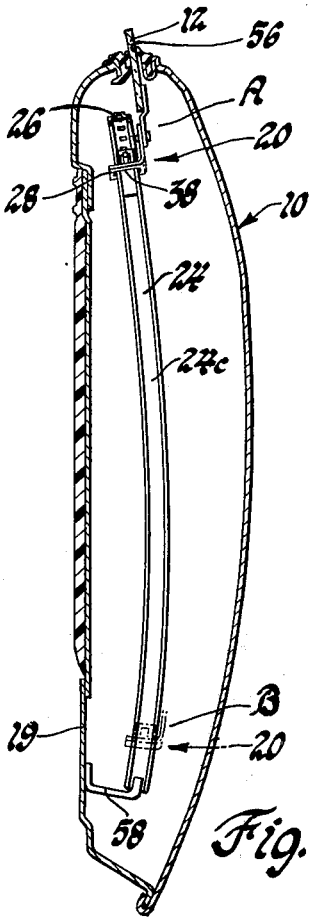
Figure 6:
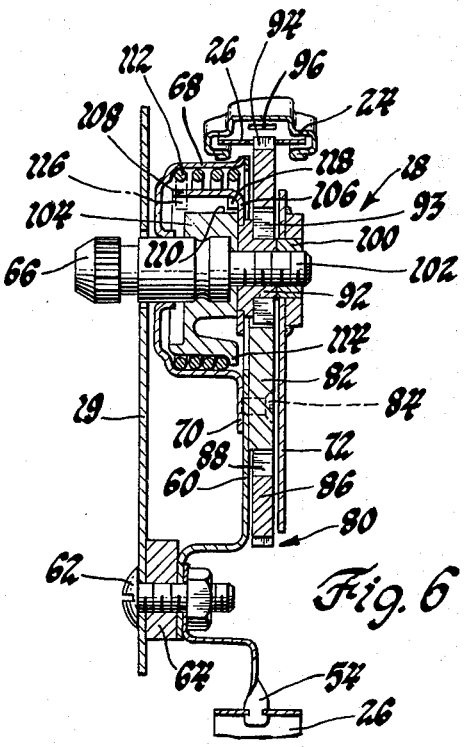
Figure 8:
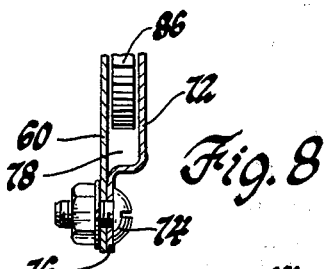
Figure 7:
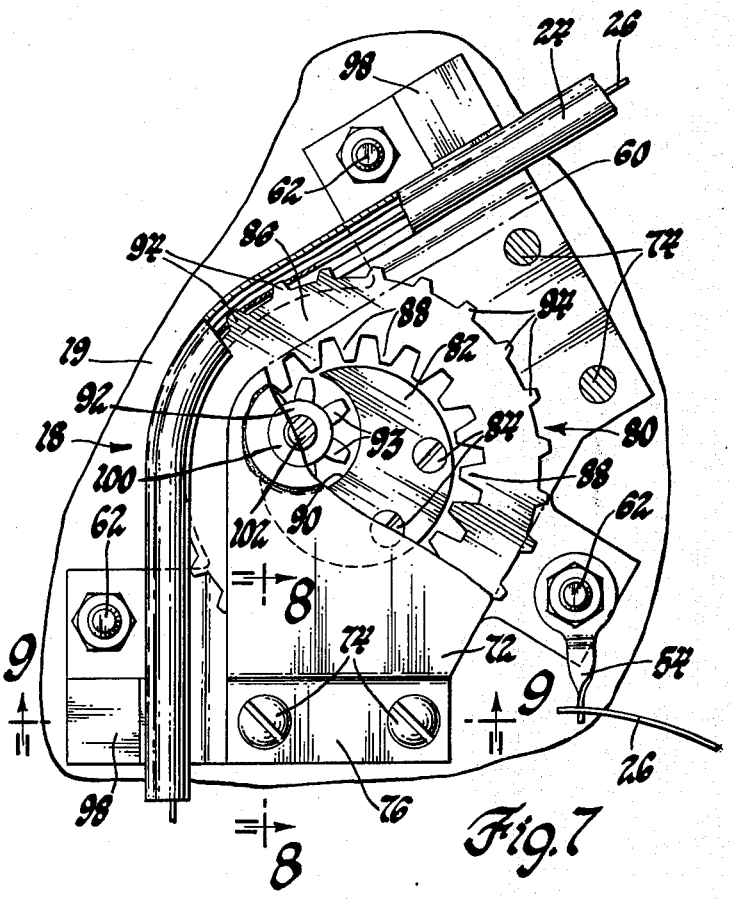
Figure 9:
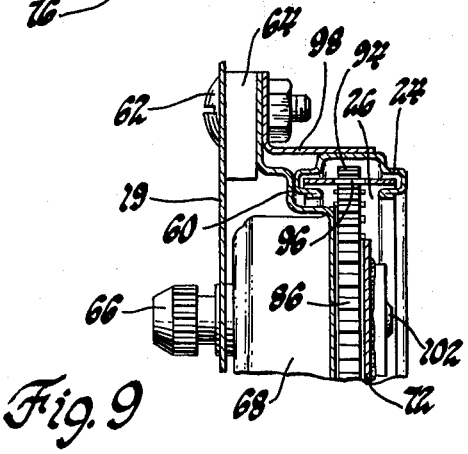

FIGS. 3 and 4 are cross-sectional views taken along the panes of lines 3—3 and 4—4, respectively, of FIG. 2, and looking in the direction of the arrows;

FIGS. 5 and 6 are cross-sectional views taken along the planes of lines 5—5 and 6—6, respectively, of FIG. 1, and looking in the direction of the arrows; and FIGS. 8 and 9 are cross-sectional views taken along the planes of the lines 8—8 and 9—9, respectively, of FIG. 7, and looking in the direction of the arrows.

Referring now to the drawings in greater detail, FIG. 1 illustrates an automotive door 10 including a window pane 12 mounted in a frame 14. The window pane 12 is actuated upwardly and downwardly by a window regulator mechanism 16.

The window regulator mechanism 16 includes an actuator assembly 18 mounted on the inner panel 19 (FIG. 6) of the door 10, a bracket assembly 20 secured to the center of the bottom edge 22 of the window pane 12, and a track 24 secured to the inner panel 19 for guiding a tape 26 (FIG. 2) which is slidably mounted therein. A flange 28, formed on the bracket assembly 20, is secured to the tape 26 in a manner to be described.

Referring now to FIGS. 2 and 3, it may be noted that the bracket assembly 20 includes an upper member 30 secured by screws 32 to the window pane 12, and a lower member 34 secured by bolts 36 to the upper member 30. The flange 28 extends laterally from the bottom portion of the lower member 34.

An opening 38 is formed in the flange 28, suitable for surrounding the track 24. The opening 38 may be formed by cutting and bending a rectangular-shaped section 40 out of the flange 28, the section 40 remaining connected at one edge thereof and extending substantially perpendicular to the plane of the flange 28. An additional opening 42 is formed in the section 40, suitable for the extension therethrough of a rectangular-shaped drive block 44. As shown in FIG. 4, the drive block 44 is mounted through an opening 46 formed adjacent one end of the tape 26, and retained therein by a collar 48 slidably mounted in an off-set portion 50 formed along the length of the back side of the track 24. A slotted opening 52 is formed along the length of the front side of the track 24 to permit the drive block 44 to travel therethrough.

In FIG. 1 it may be noted that the track 24 is formed of three sections in series, which will hereinafter be referred to as track sections 24*a*, 24*b*, and 24*c*. Section 24a is secured to the actuator assembly 18 in a manner to be described, and is mounted to extend substantially vertically relative thereto to operatively connect the tape 26 to the actuator assembly 18. The section 24*a* thus serves as an inlet section for the tape 26 which is secured at its one end portion by a tab or end-hook 54 to the assembly 18. Section 24*b* extends rearwardly within the door 10, on a shallow upward slope, from the actuator assembly 18 and the upper end of the section 24*a* to operatively connect with the bracket assembly 20 by extending through the opening 38 formed in flange 28 thereof, as described above. Section 24*c*, as best seen in FIG. 5, is curved in substantially the same arcuate shape as that of the window pane 12 to facilitate the travel of the bracket assembly 20 and, hence, of the window pane 12, from the upper closed position, represented by the letter "A", to the lower fully open position, represented by the letter "B". The window pane 12 slides through a sealed opening 56 (FIG. 3) in the top of the door 10. A mounting bracket 58 secures the lower end of the track section 24*c* to the inner panel 19 of the door 10.

As just explained, the actuator assembly 18 is located adjacent the juncture of track sections 24*a* and 24*b*. The assembly 18 is mounted on the door 10 by means of a mounting bracket 60. As better seen in FIG. 6, the bracket 60, as well as the tab or drive tape end-hook 54, is secured to the inner panel 19 by bolts 62 and a suitable spacer 64. The actuator assembly 18 includes a shaft 66 extended through the inner panel 19 and on the exposed end of which would be mounted a conventional window actuator handle [not shown].

The actuator assembly 18 further includes a housing 68 (FIG. 6) secured to the bracket 60 by any suitable means, such as welding, as at 70, for example. A cover plate 72 is secured to the bracket 60 by any suitable means, such as bolts 74 (FIG. 8), mounted through off-set flanges 76 formed on the cover 72, providing a space 78 of a predetermined width between the cover plate 72 and the bracket 60.

A clutch assembly portion 80 (FIG. 6) of the actuator assembly 18 is operatively mounted on the shaft 66 in the space 78. The clutch assembly 80 includes a retainer member 82 secured in any suitable manner, such as by set screws 84 (FIG. 7), to the mounting bracket 60. A ring gear 86 is formed to include internal teeth 88 whose inner peripheral edges are slip-fitted around the outer peripheral surface of the retainer member 82. An arcuate-shaped notch 90 is formed in the upper edge (FIG. 7) of the retainer member 82, suitable for rotatably mounting an externally-toothed pinion gear 92 therein, such that the external teeth 93 thereof mesh with the internal teeth 88 of the ring gear 86. The pinion gear 92 is secured in any suitable manner to the shaft 66 for rotation therewith.

Sprocket teeth 94 (FIG. 7) are formed on the outer peripheral surface of the ring gear 86 for meshing with equally-spaced notches 96 (FIG. 3) formed along the entire length of the tape 26. As noted in FIG. 9, the track 24, which houses the tape 26, is secured by welding and a suitable bracket 98 to the mounting bracket 60.

A nut 100 (FIG. 6) is threadedly mounted on an internal threaded end portion 102 of the shaft 66, abutting against a face of the pinion gear 92. A hub or spring retainer 104 is secured to the shaft 66 within the housing 68. A drive key includes a plate portion 106 staked to the end of the pinion gear 92, and an axially extending drive lug 108 extending through an arcuate slot 110 formed in the hub 104. A coil spring 112 is mounted around the hub 104 and the drive lug 108, and is retained circumferentially within the side walls of the housing 68 and axially between a flange 114 and an inner end surface of the housing 68. Both ends 116 and 118 of the coil spring 112 are bent inwardly to straddle the edges of the axially extending drive lug 108 in the arcuate slot 110 to provide a conventional wound-spring drive means for the clutch assembly 80.

The operation of the window regulator mechanism 16 is assumed to be apparent from the above. However, briefly, manual rotation of the shaft 66 via a conventional handle [not shown] serves to rotate the hub 104, and, hence, one of the bent ends 116 and 118, thereby causing the spring 112 to wrap tightly around the hub 104 and the drive lug 108, driving the latter and the associated pinion gear 92 whose external teeth 93, in turn, rotate the ring gear 86 by meshing with the internal teeth 88 of the latter. The sprocket teeth 94 on the outer peripheral surface of the ring gear 86 are thereby caused to rotate. Since the sprocket teeth 94 mesh with the notches 96 formed in the tape 26, the latter is forced to slide through the track 24. As explained, the tape 26 is operatively connected at one end thereof, via the components of the bracket assembly 20, to the window pane 12. Thus, while the other end portion of the tape 26 moves in a progressively decreasing loop (FIG. 1) into the track section 24*a*, as directed by the actuator assembly 18, the end connected to the bracket assembly 20 moves downwardly (FIG. 1) in the track section 24*c*, causing the window pane 12 to move from its up or closed position to its down or open position. Since the track section 24*c* is formed in a substantially arcuate shape (FIG. 5), comparable to the shape of the window pane 12, the latter will follow a path parallel to the track section 24*c* within the side walls of the door 10, the frame 14 of the window pane 12 being slidably retained within the usual sealed opening [not shown] in the window frame portion of the door 10. The operation is reversed upon manual rotation of the shaft 66 in the opposite direction.

It is apparent that the invention provides a simplified, efficient, and economical window regulator mechanism which could be adapted to a power window arrangement as well.

While but one embodiment of the invention has been shown and described, other modifications thereof are possible.

We claim:

1. For use with an automotive door having spaced inner and outer panels and a window frame, and a window pane adapted to being slidably mounted in said window frame, a window regulator mechanism comprising an actuator assembly mounted in said door on said inner panel; a bracket assembly mounted on said window pane adjacent the bottom edge thereof; a track having a slotted opening formed along the full length of one side thereof and including first, second, and third sections mounted in said door on said inner panel, said first section being secured so as to have said slotted opening positioned adjacent said actuator assembly in a forward portion of said door and extending substantially vertically downwardly from said actuator assembly, said second section being connected at one end thereof to the upper end of said first section and extending from said actuator assembly to said bracket assembly when said window pane is in a closed position in said window frame, and said third section being connected to the other end of said second section and extending downwardly therefrom in a predetermined arcuate-shaped configuration and being secured to a bottom portion of said inner panel; a plastic tape slidably mounted in said track and having one end portion thereof extending from the open end of said first track section and looped so as to be secured adjacent said actuator assembly, said plastic tape having equally-spaced perforations formed along the entire length thereof; said actuator assembly including a manually rotatable actuating shaft, a pinion gear mounted on said actuating shaft for rotation therewith, a fixed ring gear retainer, a ring gear rotatably mounted on said ring gear retainer and having internally-formed teeth meshing with said pinion gear and externally-formed sprocket teeth meshing with said perforations through said slotted opening in said track for slidably reciprocally moving said plastic tape through said first, second, and third track sections; and said bracket assembly including a first plate member secured to said bottom edge of said window pane at a central location therealong and including a portion extending beyond said bottom edge, a second plate member secured at one end thereof to said extended portion and including a first flange portion formed on the other end thereof so as to extend substantially perpendicular to the plane of said second plate member, a first rectangular-shaped opening formed in said first flange portion, a second flange portion formed on said first flange portion adjacent an edge of said first rectangular-shaped opening so as to extend substantially perpendicular to the plane of said first flange portion, a second rectangular-shaped opening formed in said second flange portion, a flanged drive pin secured to the other end portion of said plastic tape in said third track section and extending therefrom into said second rectangular-shaped opening to drive said bracket assembly and, hence, said window pane along a path parallel to said third track section intermediate said door panels in response to manual rotation of said actuating shaft.

2. For use with an automotive door having spaced inner and outer panels and a window frame, and a window pane adapted to being slidably mounted in said window frame, a window regulator mechanism comprising an actuator assembly mounted in said door on said inner panel; a bracket assembly mounted on said window pane at a central location along the bottom edge thereof; a track including first, second, and third sections mounted in said door on said inner panel, said first section being operatively connected to said actuator assembly, said second section extending from said first section to a point adjacent said bracket assembly when said window pane is in a closed position in said window frame, and said third section extending downwardly from said second section in a predetermined arcuate-shaped configuration and secured to a bottom portion of said inner panel; a plastic tape slidably mounted in said track, said plastic tape having equally-spaced perforations formed along the entire length thereof, said actuator assembly including an actuating shaft adapted to being rotated by external means, a planetary gear unit operatively connected to said actuating shaft meshing with said perforations for slidably reciprocally moving said plastic tape along said first, second, and third track sections; and said bracket assembly including a first plate member secured to said bottom edge of said window pane at a central location therealong and including a portion extending beyond said bottom edge, a second plate member secured at one end thereof to said extended portion and including a first flange portion formed on the other end thereof so as to extend substantially perpendicular to the plane of said second plate member, a first rectangular-shaped opening formed in said first flange portion, a second flange portion formed on said first flange portion adjacent an edge of said first rectangular-shaped opening so as to extend substantially perpendicular to the plane of said first flange portion, a second rectangular-shaped opening formed in said second flange portion, a flanged drive pin secured to the other end portion of said plastic tape in said third track section and extending therefrom into said second rectangular-shaped opening to drive said bracket assembly and, hence, said window pane along a path parallel to said third track section intermediate said door panels in response to rotation of said actuating shaft.

3. For use with an automotive door having spaced inner and outer panels and a window frame, and a window pane adapted to being slidably mounted in said window frame, a window regulator mechanism comprising an actuator assembly mounted in said door on said inner panel; a bracket assembly mounted on said window pane adjacent the bottom edge thereof; a track having a slotted opening formed along the full length of one side thereof and including first, second, and third sections mounted in said door on said inner panel, said first section being secured so as to have said slotted opening positioned adjacent said actuator assembly in a forward portion of said door and extending substantially vertically downwardly from said actuator assembly, said second section being connected at one end thereof to the upper end of said first section and extending from said actuator assembly to said bracket assembly when said window pane is in a closed position in said window frame, and said third section being connected to the other end of said second section and extending downwardly therefrom in a predetermined arcuate-shaped configuration and being secured to a bottom portion of said inner panel; a plastic tape slidably mounted in said track and having one end portion thereof extending from the open end of said first track section and looped so as to be secured adjacent said actuator assembly, said plastic tape having equally-spaced perforations formed along the entire length thereof; said actuator assembly including a manually rotatable actuating shaft, a pinion gear mounted on said actuating shaft for rotation therewith, a fixed ring gear retainer, a ring gear rotatably mounted on said ring gear retainer and having internally-formed teeth meshing with said pinion gear and externally-formed sprocket teeth meshing with said perforations through said slotted opening in said track for slidably reciprocally moving said plastic tape through said first, second, and third track sections; and said bracket assembly including an L-shaped plate member secured to said bottom edge of said window pane at a central location therealong, a first rectangular-shaped opening formed in the horizontal leg of said L-shaped plate member by cutting and bending vertically a section therefrom, a second rectangular-shaped opening formed in said vertical section, and a flanged drive pin secured to the other end portion of said plastic tape in said third track section and extending therefrom into said second rectangular-shaped opening to drive said bracket assembly and, hence, said window pane along a path parallel to said third track section intermediate said door panels in response to manual rotation of said actuating shaft.

4. For use with an automotive door having spaced inner and outer panels and a window frame, and a window pane adapted to being slidably mounted in said window frame, a window regulator mechanism comprising an actuator assembly mounted in said door on said inner panel; a bracket assembly mounted on said window pane adjacent the bottom edge thereof; a track having a slotted opening formed along the full length of one side thereof and including first, second, and third sections mounted in said door on said inner panel, said first section being secured so as to have said slotted opening positioned adjacent said actuator assembly in a forward portion of said door and extending substantially vertically downwardly from said actuator assembly, said second section being connected at one end thereof to the upper end of said first section and extending from said actuator assembly to said bracket assembly when said window pane is in a closed position in said window frame, and said third section being connected to the other end of said second section and extending downwardly therefrom in a predetermined arcuate-shaped configuration and being secured to a bottom portion of said inner panel; a plastic tape slidably mounted in said track and having one end portion thereof extending from the open end of said first track section and looped so as to be secured adjacent said actuator assembly, said plastic tape having equally-spaced perforations formed along the entire length thereof; said actuator assembly including a manually rotatable actuating shaft, a planetary gear unit operatively connected to said actuating shaft for meshing with said perforations through said slotted opening in said track for slidably reciprocally moving said plastic tape through said first, second, and third track sections; and said bracket assembly including an L-shaped plate member secured to said bottom edge of said window pane at a central location therealong, a first rectangular-shaped opening formed in the horizontal leg of said L-shaped plate member by cutting and bending vertically a section therefrom, a second rectangular-shaped opening formed in said vertical section, and a flanged drive pin secured to the other end portion of said plastic tape in said third track section and extending therefrom into said second rectangular-shaped opening to drive said bracket assembly and, hence, said window pane along a path parallel to said third track section intermediate said door panels in response to manual rotation of said actuating shaft.

5. For use with an automotive door having spaced inner and outer panels and a window frame, and a window pane adapted to being slidably mounted in said window frame, a window regulator mechanism comprising an actuator assembly mounted in said door on said inner panel; a bracket assembly mounted on said window pane at a central location along the bottom edge thereof; a track including first, second, and third sections mounted in said door on said inner panel, said first section being operatively connected to said actuator assembly, said second section extending from said first section to a point adjacent said bracket assembly when said window pane is in a closed position in said window frame, and said third section extending downwardly from said second section in a predetermined arcuate-shaped configuration and secured to a bottom portion of said inner panel; a plastic tape slidably mounted in said track, said plastic tape having equally-shaped perforations formed along the entire length thereof, said actuator assembly including a manually rotatably actuating shaft, a planetary gear unit operatively connected to said actuating shaft for meshing with said perforations for slidably reciprocally moving said plastic tape along said first, second, and third track sections; and said bracket assembly including an L-shaped plate member secured to said bottom edge of said window pane at a central location therealong, a first rectangular-shaped opening formed in the horizontal leg of said L-shaped plate member by cutting and bending vertically a section therefrom, a second rectangular-shaped opening formed in said vertical section, and a flanged drive pin secured to the other end portion of said plastic tape in said third track section and extending therefrom into said second rectangular-shaped opening to drive said bracket assembly and, hence, said window pane along a path parallel to said third track section intermediate said door panels in response to manual rotation of said actuating shaft.

* * * * *

UNITED STATES PATENT AND TRADEMARK OFFICE

CERTIFICATE OF CORRECTION

PATENT NO. : 4,004,371

DATED : January 25, 1977

INVENTOR(S) : Edward G. Podolan, Lawrence A. Surhigh

It is certified that error appears in the above-identified patent and that said Letters Patent are hereby corrected as shown below:

Column 8, line 12, "shaped" should read -- spaced --.

Signed and Sealed this

Twenty-eighth Day of June 1977

[SEAL]

*Attest:*

RUTH C. MASON
*Attesting Officer*

C. MARSHALL DANN
*Commissioner of Patents and Trademarks*